United States Patent [19]

Metcalfe et al.

[11] 4,193,794

[45] Mar. 18, 1980

[54] LIQUID DEVELOPERS FOR ELECTROSTATIC IMAGES

[75] Inventors: Kenneth A. Metcalfe, Lockleys; Alwin S. Clements, Largs Bay; Clive W. Wilson, Oaklands Park, all of Australia

[73] Assignee: The Commonwealth of Australia, Canberra, Australia

[21] Appl. No.: 682,371

[22] Filed: Apr. 30, 1976

Related U.S. Application Data

[63] Continuation of Ser. No. 457,136, Apr. 1, 1974, abandoned.

[30] Foreign Application Priority Data

Apr. 2, 1973 [AU] Australia ..... 2837/73

[51] Int. Cl.[2] ..... G03G 9/00

[52] U.S. Cl. ..... 430/137; 427/116

[58] Field of Search ..... 96/1 LY; 252/62.1 L; 427/16, 17, 15

[56] References Cited

U.S. PATENT DOCUMENTS

| | | | |
|---|---|---|---|
| 3,576,744 | 4/1971 | Sharrock et al. | 252/62.1 L |
| 3,622,368 | 11/1971 | Okono et al. | 427/16 |
| 3,703,400 | 11/1972 | Tamai et al. | 427/17 |
| 3,729,418 | 4/1973 | Machida et al. | 252/62 K |
| 3,817,867 | 6/1974 | Nagashima | 252/62.1 L |

*Primary Examiner*—Edward C. Kimlin

*Attorney, Agent, or Firm*—Haseltine, Lake & Waters

[57] ABSTRACT

A method of producing a liquid developer for electrostatic images by subjecting a low density polymer to a solvent of relatively smaller molecular size so that the solvent activates the polymer chains to form a modifying carrier liquid, and then applying the modifying carrier liquid to particles of solid toner material so that by dilatant action the molecular bonds of the particles are broken to produce a fine developer held in a lattice structure.

6 Claims, No Drawings

LIQUID DEVELOPERS FOR ELECTROSTATIC IMAGES

CROSS RELATED APPLICATION

This application is a continuation of co-pending application Ser. No. 457,136 filed Apr. 1, 1974, now abandoned.

This invention relates to liquid developers for electrostatic images and in particular it relates to a method of preparing a developer which can be used for, but not necessarily exclusively for, development of latent images produced on photoconductors or photoinsulators by applying the developers which contain marking particles to the surface on which the latent image fields exist.

BACKGROUND OF THE INVENTION

In the art of liquid development one of the major problems in the past has been to obtain a required degree of fineness of the developers to insure that there is no sedimentation during storage and that there is highly effective development with high resolution, conditions not possible where the developer is of a relatively coarse nature.

In the past, the method used for the production of the fine powders suspended in the carrier liquids was effected by grinding the developer medium in ball mills or the like, such grinding taking many days to produce ultra-fine developers of high quality.

This grinding was also used as a means of applying control coatings to the toner particles by carrying out the grinding in the presence of resins or other control means which served to wet the particles as they were ground to the required fineness, the control medium being in liquid form, this remaining as the outer phase which coated the particles as they were ground to the required fineness, this principle having been fully explained in earlier patents by the same Applicant and forming the basis of highly satisfactory liquid developers.

It will be realized that the finer the developers the more readily the developer particles can be suspended in an insulating carrier liquid, and by coating or surrounding the particles with the control medium, such as an insulating resin, coagulation of the particles was largely prevented because all particles were of similar polarity and the particles therefore tended to repel each other when freely supported in the liquid.

Various problems however have been encountered in the production of developers by the methods used at the present time, and an object of the present invention is to provide an improved form of manufacture of developers and also an improved form of developer itself which will have characteristics which are advanced in effectiveness over those known heretofore.

SUMMARY OF INVENTION

By extensive research, an inventive observation, we have found that, instead of using mechanical shear of particles to reduce particle size, and perhaps also to coat the particles with a control medium, we can achieve this by utilizing special solvent means to disrupt macromolecules of, for instance, carbon black or other toner medium by simply subjecting them to the action of a particular type of solvent medium.

The basis of this solvent is the use of multi-component mixture, one component being a solvent of relatively small molecular size, the other component being a low density polymer which has a substantially larger molecular size, the two substances however being compatible to form a compound solvent which we have then found acts as a dilatant for carbon particles or other toner medium, and in fact disintegrates the particles into molecular or macromolecular form, that is of extremely small size due to the liquid shear as this solvent liquid or modifying carrier liquid as we prefer to call it, penetrates the particles and the dilatent action takes place. It will be realized that the term "dilatant" is used here to describe a mechanical effect namely the strain (on a submicroscopic scale) resulting from the physical action of the solvent on the polymer, and should not be confused with the rheological property, dilatancy, which is possessed by certain suspensions.

We have found, for instance, that when carbon black, as an example, is suspended in a carrier liquid such as that sold under the Trade Mark "Isopar G" or "H", the toner particles are simply suspended in this liquid and there is a minimal action of the Isopar on the toner particles, and no disintegration due to dilatent action.

"Isopar G" (Esso Chemicals) is a hydrocarbon solvent with an aromatic content of 0.2%, boiling point range 158–177, flash point 103° F. and specific gravity 0.750 molecular weight 146.

"Isopar H" (Esso Chemicals) is a hydrocarbon solvent with an aromatic content of 0.2% boiling point range 174–191, flash point 120° F., specific gravity 0.758, molecular weight 154.

If, however, the Isopar G has a low density polymer such as styrene butadiene added to it, as sold for instance under the Trade Mark "Buton 100" the combined compatible compound solvent so formed has the effect of acting as a dilatant to the particles of developer and appears not only to disintegrate the particles of the developer to form molecules or macromolecules of a relatively small size, but such resultant particles may then also have a coating of the low density polymer, or have the low density polymer attached to them, and form perfectly controlled particles of extremely small size.

We have found also that, if the low density polyethylene is dissolved in hot Isopar, as it cools down this upgrades the solvent power of the isoparaffinic liquid to cause the dilatant effects referred to above, many forms of low density polymers in association with solvent such as Isopar having this effect and thus forming the medium of this invention.

"Buton 100" (see e.g., Modern Surface Coatings, Pgs. 241–243, by P. Nylen and E. Sunderland, Interscience Publishers, John Wiley & Sons, Ltd., London-New York-Sydnwy; or Synthetic Polymers of Petroleum Origin for Coatings by D. Koenecke and W. Nostrand, Jr., Official Digest, June 1960, pgs. 832–5) is a Trade name of Esso Chemical Company for a product obtained by the copolymerization of styrene and butadiene alone. Acid value 0, non-volatile content 100%, iodine No. 330, viscosity 3500 poise, molecular weight 2000 to 3000, hydroxyl value 0. It is a lattice type binder compatible only to a limited extent with other binders. It has a low polarity and its wetting properties are considered poor. It is soluble in both aliphatic and aromatic solvents. In the preparation of Buton polymerization occurs approximately to equal amounts by 1,4 and by 1, 2 addition. The probable structure is as follows:

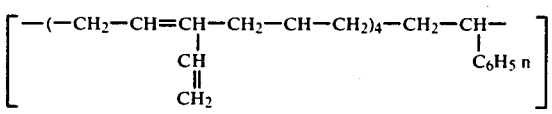

The modified carrier liquid is able to enter the toner material and break the bonds of the molecules or macromolecules by the passing of the modified carrier liquid into the substance itself. Liquid shear or continued dilatant action then breaks down the toner medium to an extremely fine form, the fineness and the coating insuring that the developer so produced has long life and is highly stable and moreover is of a uniform nature due to the affinity of the modifying carrier liquid for the surface of the particles as they are disintegrated into their colloidal or near colloidal form.

The invention appears to use the properties of isco-elastic fluids in that the solvent mixture appears to possess both viscous and elastic properties, as is typical of solutions of macromolecules and molten polymers. It must be realized that in the steady flow of solutions of macromolecules and polymer melts, substances which they wet are subject to such elastic action and it is believed to be the basis of the disruption of dilatant effects.

It will be realised that dilatant fluids are time-independent in contra-distinction to rheopectic fluids and this is one of the factors which is considered to be important in the present invention. The compound solvent formed by the combination of a normal solvent such as Isopar with a low density polymer forms a continuing active dilatant for carbon black and similar toner materials. It also forms a better means for breaking the internal bonds at least partly due to the elastic effects as the polymers are drawn into the toner medium and dilated so that they can then disintegrate the toner medium by the elastic action given by the compound solvent medium.

It was found that there is an almost immediate breakdown of the toner medium to what appears to be a colloidal or near colloidal form This was observed to take place when the "compound solvent", as we term it, was simply formed and then added to the toner medium and shaken up to produce an ultra-fine developer with all the characteristics of a controlled developer previously produced by grinding of the toner particles in the presence of a resin or oil or other wetting agent for the surface of the particles.

The following examples show how the invention can be carried into effect.

EXAMPLE 1

A developer for electrostatic and electrographic images is prepared from the following materials:

Carbon black (Mogul Special or Kohinoor black): 1 gram

Styrene-butadiene-polymer, Buton 100, 20 grams (low density polymer, latice forming):

Isoparaffinic liquid, Isopar G: 400 milliliters

The styrene-butadiene polymer is first dissolved in the isoparaffin liquid until a clear solution is obtained. Rate of solution may be increased by heating to the boiling range of the isoparaffin. The solution constitutes a liquid of high electrical volume resistivity. The carbon black is then stirred into this solution and dispersion assisted by heating or by ultrasonic agitation. Dispersion will continue on standing for approximately 24 hours at room temperatures, producing stable suspensions. The developer is applied to a latent electrostatic image or charge pattern by means of a squeegee roller or the like, or used to coat metal surfaces or other surfaces by introducing an electric field of about 1000 volts per centimeter.

EXAMPLE 2

In Example 1, the carbon black is replaced by one or more of the following pigments; B.A.S.F. Fanal Pink 4810; phthalocyanine blue Graphtol Blue BLF; Graphtol Yellow AGL (Sandoz) (2-Nitro-p-toluidine→aceto acetanilide), or pigment white 6 C.I. 77891, Titanium dioxide; or zinc oxide, pigment white 4, C.I. 77947, or lithopone, zinc sulphide, pigment white 5, 7, C.I. 77115.

EXAMPLE 3

In Example 1, the carbon black is replaced by barium chromate/strontium chromate, pigment yellow 31/32 C.I. 77103 or yellow oxide, pigment yellow 42/43, C.I. 77492 ferrichydrate or iron oxide yellow; or chrome yellow 34, C.I. 77600, or chrome orange, pigment orange 21; or cadmium yellow, pigment 37, C.I. 77199; or cadmium orange, pigment orange 20, C.I. 77196/77199 (cadmium sulphide/cadmium selenide); or cadmium red, pigment red 108, C.I. 77196; or red oxides, pigment red 101/102 C.I. 77491; ferric oxide; or aluminum powder, pigment metal 1, e.g. atomised aluminum powder, Beith Chemical Manufacturers, or bronze powder, or zinc dust or cuprous oxide or fluorescent pigments e.g. Lumogen blue, green, yellow or red of B.A.S.F. Australia, or red lead or litharge; or aniline black, pigment black 1 C.I. 50440 (azine) e.g. C.I. BA or Geigy Irgalite Black SN, or magnetic iron oxide; or graphite, or manganese dioxide.

EXAMPLE 4

A developer for electrostatic and electrographic images is prepared from the following materials:

| | |
|---|---|
| Carbon Black, pigment black 7, C.I. 77266, Acarb FEF, Australian Carbon Black, blue-tone | 2 grams |
| Polyethylene, low density, 617A | 10 grams |
| Isoparaffin liquid, Isopar G or Isopar M | 400 milliliters |

Low density polyethylene uses polymerization of ethylene at 100°-300° C. in the presence of a peroxide catalyst. An alternative process employs the presence of an aromatic hydrocarbon which acts as a diluent in preventing cross-linking. Typical properties include melting point 85° to 110° C., specific gravity 0.9 tensile strength 1400 p.s.i.

The low density polyethylene is dissolved in the Isopar G at 70° C. to form a solution of high electrical volume resistivity. The carbon black is then stirred into the hot solution and dispersion is assisted by ultrasonic agitation for 1 minute. Improved dispersion is obtained on standing for 48 hours if desired.

EXAMPLE 5

In Example 4, the carbon black is replaced by one or more of the following pigments; vinilplast E.B. black (Sandoz); zinc oxide; a phthalocynine blue, Graphtol BLF, (Sandoz); Fanal Pink, B.A.S.F., Graphtol Yellow RCL, (Sandoz pigment yellow 83) or Helio Fast Black 1RK (Bayer) anthraquinone black.

EXAMPLE 6

In Example 1 or example 4 the carbon black is replaced by one or more of the following oil soluble dyes; Ceres brown 3B, solvent red[2]; Ceres Orange G, solvent orange 1, Bayer; Ceres red G, solvent red 1, Bayer; ceres yellow 3G, solvent yellow 66, Bayer, sudan yellow BG, solvent yellow 16, B.A.S.F. Aust., Sudan deep black BB, solvent black 3, B.A.S.F. Aust; or Waxoline yellow 1, I.C.I. ANZ, Solvent yellow 14; Waxoline Red 0, Solvent Red 24, I.C.I. ANZ: Waxoline blue 45, solvent blue 36, I.C.I. ANZ: Waxoline green G.S., solvent blue 4, I.C.I. ANZ.

EXAMPLE 7

In Example 1 or 4 in addition to the Buton 100 or polyethylene, 0.5 gram of VTAC-L (Low density vinyltoluene acrylic copolymer) is added to the hot Isopar G liquid together with Buton 100 or polyethylene and the pigment is added subsequently. Additional fixative action is thus provided.

EXAMPLE 8

In Example 1, the Buton 100 low density polymer is replaced by a hydrocarbon polymer such as PICCO 6140-3, which is soluble in aliphatic and aromatic hydrocarbons, or it is replaced by latices of the styrene or styrene copolymers or other types as follows:

Ucecryl AS, an acrylic styrene by Albright & Wilson, non-volatile 47%, viscosity 0.5–1.0 poise, S.G. 1.05.

Mowilith DM60 a styrene acrylic by Hoechst, non-volatile 50% viscosity 40 poise, S.G. 1.09.

Acronal 290D an acrylic by BASF Aust., N.V. 48% viscosity 5–15 poise, S.G. 1.04.

Latex 307 a styrene-butadiene by Dow Chemical N.V. 48%, S.G. 1.01.

Synthemul 40-b 408 a styrene-acrylic-acrylonitrile, by Hatrick, N.V. 40%, viscosity 0.2–1.0 poise S.G. 1.03.

Synthemul 9201 a styrene homopolymer, by Hatrick, N.V. 36%, viscosity 0.15–0.35 poise, S.G. 1.02.

Vinamul 63818 a styrene acrylic, by Hatrick, N.V. 50%, viscosity 5–10 poise.

Butakon SL103 a styrene-butadiene, by ICIANZ, N.V. 45.5% viscosity 3.5 poise, S.G. 1.01.

Butakon XSL238 a styrene-butadiene, by ICIANZ N.V. 54%, Viscosity 2.5 poise, S.G. 1.00.

Revacryl 1 A an acrylic, by Revertex, N.V. 51–52%, viscosity 25–35 poise, S.G. 1.11.

Lytron 680 a stryene-acrylics, by Monsanto, N.V. 47%, viscosity 0.2–1.1 poise, S.G. 1.02.

Hetropol SA505 a styrene-acrylic esters, by Polymer, N.V. 46%, viscosity 10–20 poise, S.G. 1.05.

Revacryl 144 a styrene-acrylic by Revertex, N.V. 50.5% viscosity 1 poise, S.G. 1.02.

Morton latices a styrene-acrylonitrile, by Swift, N.V. 45% viscosity 45–100 poise, S.G. 1.03.

Vinacryl 63–822 a styrene-acrylic by Hatrick, N.V. 49–51%, viscosity 2.5–5.0 poise, S.G. 1.02–1.04.

Revacryl 344 a styrene-acrylic by Revertex, N.V. 56–57% viscosity 2–4 poise, S.G. 1.02.

Kurofan 191D a vinylidene chloride polymer, by BASF Aust., N.V. 55% viscosity 0.08–0.12 poise, S.G. 1.29.

Propiofan 5D a vinyl propionate polymer, by BASF Aust., N.V. 50% viscosity 150–230 poise, S.G. 1.13.

Synthemul 9581 a ethylene homopolymer, by Hatrick, N.V. 25% viscosity 0.1–0.2 poise, S.G. 1.00.

Breon Latices a acrylonitrile-butadiene by BP Aust.

Ucecryl 7089 an acrylic copolymer, by Albright & Wilson, N.V. 47%, viscosity 6.0–7.0 poise, S.G. 1.05–1.07.

Ucecryl 546 an acrylic homopolymer by Albright & Wilson, N.V. 46%, viscosity 0.2–0.3 poise, S.G. 1.04–1.06.

Primal AC507 an acrylic copolymer by Robert Bryce,

What is claimed is:

1. A method of producing a liquid developer for electrostatic images in which an electrically insulating carrier liquid has suspended in it a particular toner medium, which method consists of first adding a substance consisting of a polymer to a solvent adapted for being imbibed into the polymer such that the solvent is imbibed into the polymer to form a modifying carrier liquid, said polymer having a molecular weight between 2000 and 3000 and being selected from the group consisting of polyethylene and styrene-butadiene copolymer, said solvent being isoparaffinic liquid having a molecular weight between 100 and 300 and then applying the modifying carrier liquid to particles of solid toner material, the formation of the modifying carrier liquid being such that the modifying carrier liquid is drawn into the solid toner particles and by dilatant action causes the molecular bonds of the said particles to be broken to produce a developer comprising minute developer particles suspended in said carrier liquid.

2. The method of claim 1 wherein the modifying carrier liquid is applied to the particulate solid toner and the mixture is agitated to increase the rate of dilation.

3. The method of claim 1 wherein the molecular weight of the solvent to the molecular weight of the polymer is in the general ratio of one to ten.

4. The method of claim 1 wherein the polymer is a product obtained by the copolymerization of styrene and butadiene and which has an acid value 0, non-volatile content 100 percent iodine No. 330, viscosity 3500 poise, hydroxyl value 0, and is a lattice type binder compatible only to a limited extent with other binders and of low wetting power.

5. The method of claim 1 wherein the low density polymer is used in conjunction with a low density vinyltoluene acrylic copolymer for added fixing.

6. The method of claim 1 wherein the solid toner material is carbon black.

* * * * *